US005176419A

United States Patent [19]

Guerdet

[11] Patent Number: 5,176,419

[45] Date of Patent: Jan. 5, 1993

[54] HARDWARE CARRIER

[76] Inventor: Dennis W. Guerdet, RR1 - Box 118 - 4008 - 60 Ave., Swea City, Iowa 50590

[21] Appl. No.: 720,242

[22] Filed: Jun. 24, 1991

[51] Int. Cl.[5] ..... B65D 71/00; B65D 85/00

[52] U.S. Cl. ..... 294/146; 206/303; 211/59.1; 294/143; 294/158; 294/160

[58] Field of Search ..... 294/143, 144, 146, 158-163; 206/303, 372, 373, 379, 443, 445, 499; 211/10, 13, 49.1, 59.1, 60.1, 70.6, 126; 312/107, 107.5, 128, 244, 257.1

[56] References Cited

U.S. PATENT DOCUMENTS

| | | | |
|---|---|---|---|
| 444,328 | 1/1891 | Boss | 211/59.1 |
| 486,640 | 11/1892 | Gingras | 211/59.1 |
| 1,500,018 | 7/1924 | Whitaker | 294/158 |
| 2,341,635 | 2/1944 | Loesch | 294/158 |
| 2,398,896 | 4/1946 | Simmons et al. | 294/158 |
| 2,974,781 | 3/1961 | Zimmerman | 211/59.1 X |
| 3,195,717 | 7/1965 | Senter | 206/303 |
| 4,030,599 | 6/1977 | Bruni | 211/70.6 X |
| 4,353,465 | 10/1982 | Rado | 211/70.6 X |

*Primary Examiner*—Johnny D. Cherry
*Attorney, Agent, or Firm*—Herman H. Bains

[57] ABSTRACT

A hardware carrier for carrying sorting and displaying nuts, bolts, washers and lock washers includes a generally rectangular shaped lower base member, an upper base member and a cover. The lower base member has a plurality of openings therein for supporting and displaying bolts of varying sizes. The upper base member has a plurality of posts therein for supporting and displaying a plurality of nuts, washers and lock washers of varying sizes. The upper base member is releasably locked to the cover and lower base member when the hardware carrier is in carrying mode.

3 Claims, 1 Drawing Sheet

HARDWARE CARRIER

FIELD OF THE INVENTION

This invention relates to a hardware carrier device and more particularly to a hardware carrier device for bolts, nuts, washers, and burrs.

BACKGROUND OF THE INVENTION

During the maintenance or repair of vehicles, machinery, implements and the like, it is often necessary to replace bolts, washers, lock washers, nuts or similar hardware items. These hardware items (bolts, washers, lock washers and nuts) are sometimes kept in tool boxes, portable bins and similar containers and are carried in farm implements, cars, trucks and similar vehicles for ready availability. However, a user often times is required to search through drawers, small boxes or similar containers in an effort to locate the needed component.

Most of the conventional carrier devices are not constructed or arranged to effectively sort the hard ware items for ready retrieval. U.S. Pat. No. 444,328 to Boss, while disclosing a holder for washers and nuts, does not disclose a carrier capability for bolts.

SUMMARY OF THE INVENTION

An object of this invention is to provide a hardware carrier device, of simple and inexpensive construction, which sorts, displays and supports nuts, washers, lock washers and bolts to permit ready access to these components by a user.

The hardware carrier device is comprised of three principle units, namely, a lower base, an upper base and a retainer cover. The lower base has a generally flat top wall which is provided with a plurality of variously sized openings each accommodating a bolt of predetermined size. The upper base includes a substantially flat wall having a plurality of posts secured to the upper surface thereof. These posts are of varying cross-sectional size each accommodating thereon a plurality of washers, nuts or lock washers of a preselected size. The upper base is releasably secured to the lower base for retaining the bolts on the lower base when the carrier is in a closed carrying mode. The retainer cover is secured to vertical locking members on the upper base and is disposed closely adjacent the posts for retaining the nuts, washers and lock washers thereon when the carrier is in the closed carrying mode.

FIGURES OF THE DRAWING

DESCRIPTION OF THE PREFERRED EMBODIMENT

Figure 1:
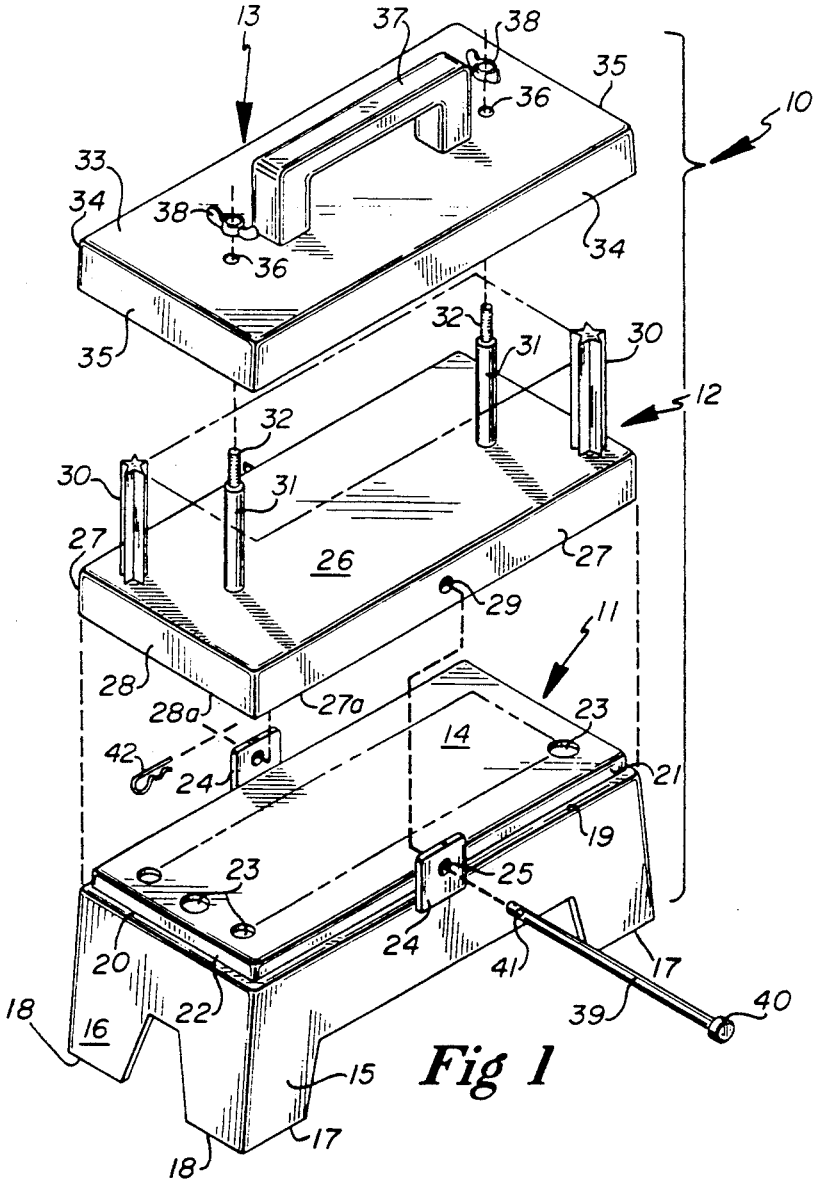
FIG. 1 is an exploded perspective view of the novel hardware carrier device.

Referring now to the drawings, it will be seen that the novel hardware carrier device, designated generally by the reference numeral 10, is comprised of a lower base member 11, an upper base member 12 and a retainer cover 13. The lower base member 11 is of generally rectangular shaped configuration and includes a substantially flat rectangular top wall 14 which is rigidly secured to longitudinally extending side walls 15 and transversely extending end wall 16. The side walls 15 have lower longitudinal edges 17 and the end walls 16 have lower transverse edges 18. These lower edges of the side and end walls are disposed in a single plane to permit the hardware carrier device 10 to be placed upon a flat surface. In the embodiment shown, the side walls and end walls are shaped to define legs whose lower edges are disposed in a single horizontal plane.

It will be noted that the top wall 14 of the lower base member is offset inwardly to thereby define upwardly facing longitudinal shoulders 19 and upwardly facing transverse shoulders 20. This inwardly offset configuration of the top wall also defines longitudinal vertical edges 21 and transverse vertical edges 22. The top wall 14 also has a plurality of openings 23 therein and a pair of vertically extending tabs 24 are secured to the longitudinally extending side walls 15 adjacent the mid-portion thereof. Each of the vertical tabs has an opening 25 therein, the openings being disposed in aligned relation with respect to each other.

The openings 23 in the top wall are of varying size to accommodate bolts B of different diameter. In the embodiment shown, the openings 23 are arranged in longitudinally extending rows with the openings of each row gradually increasing in size from one end to the other. Thus, the bolts in each longitudinal row would vary in size from one end of the row to the other. In the preferred embodiment, it is preferred that the rows be duplicates of each other so that there will be several bolts of the same size (diameter) supported on the lower base member. It will be noted that the two outer rows of bolts are arranged in progressively increasing diameter size in one direction while the central row of bolts is arranged in the opposite direction. The heads of the bolts will engage the upper surface of the top wall 14 when the bolts project through the openings and the vertical dimension of the side and end walls is sufficient to space the lower ends of the bolts at locations above the lower edges of the side and end walls.

The upper base member 12 is also of generally rectangular configuration and includes a substantially flat generally rectangular shaped upper wall 26 having elongate longitudinal walls or flanges 27 integrally formed therewith and depending therefrom. The upper wall is also integrally formed with transverse end walls or flanges 28. Each longitudinal wall 27 has a centrally located opening 29 therein and these openings are disposed in transverse alignment with each other.

When the upper base member 12 is positioned upon the lower base member 11, the lower edges **27*a* of the longitudinal flanges 27 will engage the longitudinally extending shoulders 19 while the lower edges 28*a* of the end flanges 28 will engage the transversely extending shoulders 20. The openings 29 will be disposed in alignment with the openings 25 in the tabs 24 to permit an elongate bolt 39 to be extended through the tabs of the lower base member 11 and through the longitudinal flanges of the upper base member 12. The bolt 39 has a bolt head 40 at one end and has an opening 41 in the other end portion. The head 40 of the bolt 39 will engage one of the tabs and the other end of the bolt, which projects through the other tab, will be secured in place by a cotterpin 42. This arrangement permits the upper base member 12 to be releasably locked to the lower base member 11 so that the upper wall 26** prevents accidental dislodgment of any of the bolts B from the lower base member.

The upper base member 12 also has a plurality of posts 30 integrally formed therewith and projecting upwardly therefrom. It will be noted that the posts 30 are of uniform height and are star-shaped in cross-section. The posts are also of varying cross-sectional size and are arranged in longitudinal rows in the same manner as the openings 23 in the top wall 14 of the lower base member 11. Thus, the posts in a row increase in cross-sectional size from one end thereof to the other. Each post accommodates a plurality of nuts N or washers W thereon. The nuts, washers and lock washers on one post will be of a different predetermined size than the nuts, washers or lock washers on the next adjacent post in a row. With this arrangement, nuts, lock washers and washers of varying sizes are supported and displayed on the various posts on the upper base member.

The upper base member also has a pair of vertically projecting cover engaging elements 31 integrally formed therewith and projecting upwardly therefrom. In the embodiment shown, the cover engaging elements 31 are disposed in the longitudinal center line plane of the upper base member 12 and each has a reduced vertically projecting threaded upper end 32.

The retainer cover 13 is also of generally rectangular configuration and includes a substantially flat, generally rectangular shaped upper wall 33. The upper wall 33 has a pair of laterally spaced apart longitudinal flanges 34 integrally formed therewith and depending therefrom. The upper wall 33 also has a pair of transverse flanges 35 integral therewith and depending therefrom. The upper wall 33 of the cover 13 has a pair of longitudinally spaced apart openings 36 therein and these openings are disposed in the longitudinal center line plane of the cover. A U-shaped handle 37 is rigidly secured to the upper surface of the upper wall 33 and projects upwardly therefrom. It will be noted that the handle is positioned between the openings 36.

The cover 13 maybe readily applied or removed from the cover engaging elements 31 to permit access to the nuts, washers or lock washers supported on the upper base member 12. When the cover 13 is in the closed condition, the vertically projecting threaded upper ends 32 of the cover engaging elements 31 will project through the openings 36 in the upper wall 33. Suitable wing nuts 38 engage the threaded upper end 32 to releasably secure the cover 13 against the upwardly facing annular supporting surface of the cover engaging elements 31. When the cover is in the closed position, it will be positioned in closed proximal relation above posts 30 to prevent accidental dislodgment of the nuts, washers or lock washers from the posts. The U-shaped handle 37 permits a user to carry the hardware carrier device for easy transport.

The hardware carrier device can be carried in any kind of vehicle including farm vehicles, trucks and automobiles or may be carried and retained in various locations in large machine shops. When the hardware carrier device 10 is in the carrying mode, the cover, 13 will be secured to the cover engaging elements 31 of the upper base 12 and the upper base will be secured in releasably locked condition to the lower base 11. All of the hardware items will be retained against accidental dislodgement when the hardware carrier device is in this carrying mode. However, if a user needs a nut, washer or lock washer, it is merely necessary to remove the wing nuts 38 and remove the cover from the upper base. The user then may select the particular size nut, washer or lock washer needed and the cover maybe replaced. Similarly, if a bolt of predetermined size is required, it is merely necessary for the user to remove the locking bolt 39 and thereafter remove the upper base 12 from the lower base 11. The proper size bolts can be selected and the upper base 12 may then be reapplied to the lower base 11 in locked relation therewith.

Figure 3:
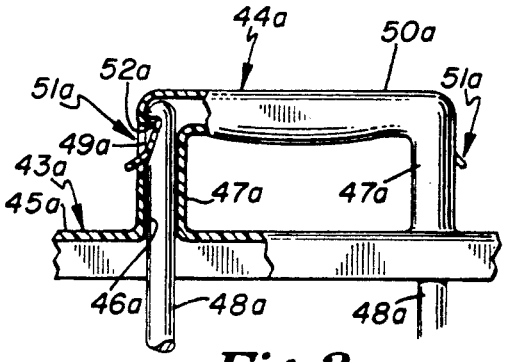
FIG. 3 is a fragmentary elevational view of a portion of the novel hardware carrier illustrating a different embodiment of the retainer cover and handle.

Referring now to FIG. 3 it will be seen that a different embodiment of the retainer cover and handle is thereshown. The modified retainer cover is designated generally by the reference **43*a* and is similar in construction to the embodiment of FIG. 1. The retainer cover 43*a* is provided with a hollow U-shaped handle 44*a* integral with the upper wall 45*a* of the retainer cover. The upper wall 45*a* has openings 46*a* therein which communicate with the hollow interiors of the legs 47*a* of the handle 44*a***.

Figure 2:
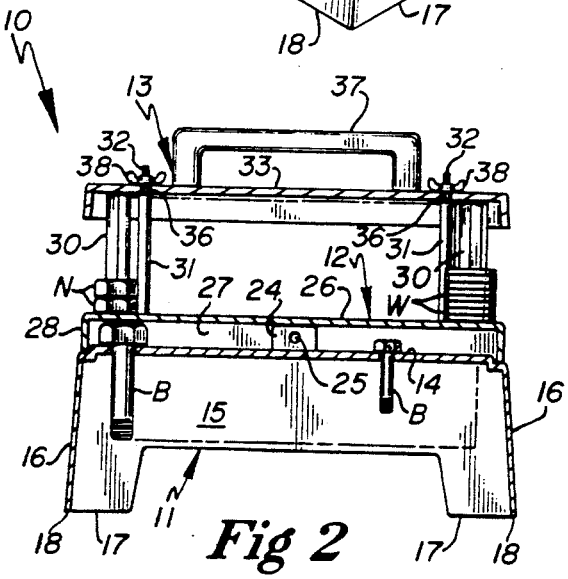
FIG. 2 is a cross-sectional view of the hardware device illustrating the manner in which hardware components are supported.

The posts **48*a* project into the hollow legs rather than through openings in the upper wall with respect to the embodiment of FIGS. 1 & 2. Each leg 47*a* has an opening 49*a* therein adjacent the bight portion 50*a* of the handle. The handle 44*a* has a pair of resilient snap lock elements 51*a* integrally formed with the legs 47*a* and projecting into the openings 49*a*. The upper end of each post 48*a* has a locking recess 52*a* therein for snap coupling effect with the lock elements 51*a*. The lock elements 51*a* have an extension projecting beyond the openings 49*a* to facilitate unlocking of the retainer cover 43*a* with respect to the posts 48*a*. The retainer cover 43*a* is identical in all other respects to the retainer cover 13**.

It will be seen that the hardware carrier device not only provides a means for carrying the various hardware items but sorts these items according to various sizes. However, one of the principle advantages of the hardware carrier device is that it displays all of the various size hardware items to a user for ready selection. Thus, a user will be informed as to which hardware components have been depleted by merely glancing at the carrier device. This allows the depleted components to be readily replaced. The carrier device also obviates the need to fumble through a drawer or bin looking for the correct size hardware item.

Thus, it will be seen that I have provided a novel carrier device which is not only of simple and inexpensive construction, but one which functions in a more efficient manner than any heretofore and known comparable device.

What is claimed is:

1. A carrier device for use in supporting, sorting and visibly displaying nuts, bolts, washers and lock washers comprising;

a lower base member having a substantially flat top wall, means secured to said top wall and depending therefrom to define legs for supporting said lower base member, a plurality of various sized openings in said top wall for accommodating the shanks of various sized bolts having heads, the bolt head-engaging the upper surface of the top wall, an upper base member positioned upon said lower base member and including a substantially flat upper wall, cooperating locking means releasably locking the upper base member upon the lower base member to position the upper wall of the upper base member in overlying close proximal relation to the heads of bolts supported on said lower base member to thereby prevent accidental displacement of the bolts from the lower base member, said upper base member when unlocked from said lower base member permitting removal of the upper base member from the lower base member and thereby allowing ready access to the bolts supported on the lower base member, a plurality of vertically disposed posts secured to the upper surface of the upper wall of the upper base member, said posts having substantially the same vertical dimension but varying in cross-sectional size to permit various size nuts, washers and lock washers to be positioned on the posts, vertically project cover engaging elements secured to the upper base member and projecting upwardly therefrom, said cover engaging elements having upper ends, a substantially flat cover engaging the cover engaging elements and being positioned in close proximal relation to said posts for preventing accidental dislodgment of the washers, lock washers and nuts from the posts, means for releasably securing said cover to the cover engaging elements, said securing means being releasable for removal of the cover to permit access to the nuts, washers and lock washers positioned on said posts, and a handle secured to said flat cover and projecting upwardly therefrom.

2. The carrier device as defined in claim 1 wherein said lower base member, said upper base member and said cover are of generally rectangular configuration.

3. The carrier device as defined in claim 1 wherein said posts are of star-shaped cross-sectional configuration.

* * * * *